United States Patent [19]

Bylin et al.

[11] Patent Number: 4,468,557

[45] Date of Patent: Aug. 28, 1984

[54] CONFORMABLE ELECTRIC HEATING APPARATUS

[75] Inventors: Robert O. Bylin, Belmont; Stephen J. Bourdette, Fremont, both of Calif.

[73] Assignee: Bylin Heating Systems, Inc., Redwood City, Calif.

[21] Appl. No.: 463,350

[22] Filed: Feb. 3, 1983

[51] Int. Cl.[3] ..... H05B 3/36

[52] U.S. Cl. ..... 219/535; 219/528; 219/541; 219/544; 219/549; 338/210; 174/51

[58] Field of Search ..... 219/211, 212, 345, 527, 219/528, 535, 529, 536, 541, 544, 549; 338/210, 308, 309, 314, 34, 35; 174/51

[56] References Cited

U.S. PATENT DOCUMENTS

| | | | |
|---|---|---|---|
| 2,802,092 | 8/1957 | MacKendrick | 219/549 X |
| 2,845,519 | 7/1958 | Willat | 219/528 |
| 2,938,992 | 5/1960 | Crump | 219/528 |
| 3,099,540 | 7/1963 | Eisler | 219/549 X |
| 3,374,338 | 3/1968 | Morey | 219/529 |
| 3,393,297 | 7/1968 | Hart | 219/528 |
| 3,470,350 | 9/1969 | Lewis | 219/211 |
| 3,627,981 | 12/1971 | Kuhn | 219/212 |
| 3,657,517 | 4/1972 | Hoyt | 219/535 |
| 3,705,375 | 12/1972 | Hershler | 338/35 |
| 3,904,850 | 9/1975 | Johnson | 219/528 |
| 4,245,149 | 1/1981 | Fairlie | 219/528 |

*Primary Examiner*—Volodymyr Y. Mayewsky
*Attorney, Agent, or Firm*—Thomas H. Olson

[57] ABSTRACT

A planar electrical heating unit that is sufficiently flexible to be conformable to nonplanar surfaces such as the exterior of pipes and tanks. The unit is formed of plural layers. There are two glass fiber reinforced silicon rubber layers between which is sandwiched an electric resistance heater element. On one outside surface is adhesively secured an imperforate metal plate. Mounted to the plate is a junction box for electrical connections to the heating element and for ground connection to the metal plate. A thermoelectric sensor is housed within the junction box and serves to interrupt current to the heating element when a prescribed temperature has been reached. Adjacent the edge margins of the unit are a plurality of grommets which prevent delamination of the layers of the device and facilitate mounting the device to the exterior surface of a pipe, tank, or the like.

4 Claims, 4 Drawing Figures

CONFORMABLE ELECTRIC HEATING APPARATUS

BACKGROUND OF THE INVENTION

1. Field of the Invention

This invention relates to planar heating apparatus that is conformable to nonplanar shapes such as cylindric surfaces of pipes and tanks and the like.

2. Description of the Prior Art

In many industrial installations it is necessary to apply heat to the wall of a tank or pipe at one or more localized areas. A convenient technique for applying heat is the provision of an electrically powered unit containing one or more resistive heating elements and being conformable to the surface of the tank or pipe. One such unit is exemplified by U.S. Pat. No. 3,904,850 in which there is disclosed a multilayer flexible heater panel the mechanical integrity of which is maintained by an insulative face layer having side portions folded over the edges of the device. The patented panel also includes a flexible ground layer formed of wire screen embedded between layers of insulation.

SUMMARY OF THE INVENTION

Heating apparatus embodying the present invention includes plural congruent planar elements that are adhesively and mechanically joined to one another. There is a flexible insulative ply to one surface of which is adhered an elongate resistive heating element. Overlying the heating element is an insulative lamination and overlying the lamination is a conductive sheet. The planar elements are adhesively joined to one another, and at the corners of the apparatus there are registered holes in the elements through which metallic grommets are installed. Not only do the grommets assist in retaining the apparatus in assembled relationship but they can receive wire, studs or like mounting members to facilitate retaining the apparatus in close conforming contact with the external surface of a tank or pipe.

An object of the invention is to provide a conformable heating apparatus that is highly immune to damage. Heating apparatus of the type disclosed herein is typically installed in environments where it may be subject to abrasion or other abuse. Heating apparatus according to the present invention has an exterior surface formed by an impervious conductive sheet which is highly resistant to abrasions and physical impacts.

A feature and advantage of heating apparatus having an external impervious conductive sheet is that the sheet can be established at ground potential so if the sheet is inadvertently pierced, it will in all likelihood establish electrical contact between the sheet and the resistive heating elements and therefore open circuit breakers or fuses in the power line to the apparatus. Moreover, if a worker pierces the sheet with a metallic tool, contact between the tool and the grounded conductive sheet will reduce or eliminate the likelihood of electric shock to the worker.

Another object of the invention is to provide an apparatus of the type described which has a self-contained thermal cutout switch to limit the temperature of the apparatus and the structure on which it is mounted. This object is achieved by providing a junction box secured to the conductive sheet and by installing within the junction box in heat conducting relation to the sheet a thermal cutout switch which opens the electric circuit to the heating element at a prescribed temperature.

After fabrication, the interior of the junction box is filled with potting compound to exclude moisture from the interior of the junction box and to afford substantial mechanical integrity to the assembly.

The foregoing, together with other objects, features and advantages, will be more apparent after referring to the following specification and the accompanying drawings.

DESCRIPTION OF A PREFERRED EMBODIMENT

Figure 4:
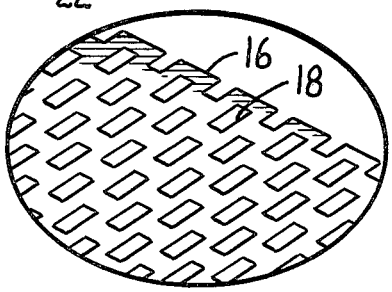
FIG. 4 is an enlarged fragmentary view of a portion of FIG. 3 taken at line 4—4 of FIG. 3.

Referring more particularly to the drawing, reference numeral 12 generally indicates heating apparatus constructed in accordance with the invention which is mounted to the exterior surface of a generally cylindric tank T. Apparatus 12 is of multilayer construction and includes a flexible insulative ply 14, the outer surface of which is adapted for contact with the exterior surface of tank T. In one apparatus designed in accordance with the invention, insulative ply 14 is formed of glass reinforced silicone rubber having a thickness of about 0.028 inches. Adhered to the inner surface of insulative ply 14 is a resistive heating element 16. Heating element 16 is preferably formed of Inconel or material of like thermoelectric characteristics. As seen most clearly in FIG. 4, resistive heating element 16 is formed of a planar sheet of Inconel having uniformly positioned punchouts 18. The punchouts are located in a pattern to establish the cross-sectional area of the material to produce the desired electrical conduction and heat producting characteristics. A suitable form of the material has a thickness of about 0.002 inches and it is uniformly spaced throughout the area of ply 14 (See FIG. 3.) with setbacks at the edge margins and corners of the apparatus. Ribbon conductors 19 are provided for interconnecting individual segments of heating element 16 and establishing electrical continuity throughout the segments.

Figure 2:
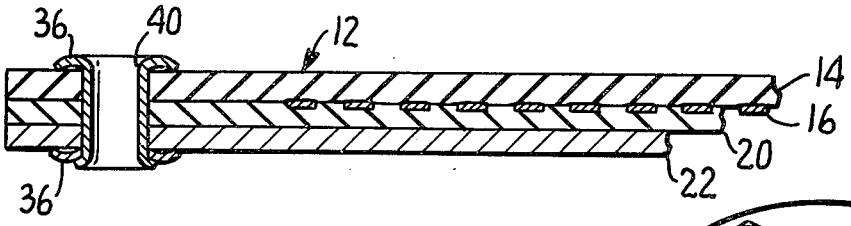
FIG. 2 is a fragmentary cross-sectional view of the heating apparatus taken along the line 2—2 of FIG. 1.

Overlying heating element 16 and the inner surface of ply 14 is an insulative lamination 20. Lamination 20 can be formed of the same material as ply 14 and is adhesively bonded to the ply. Because of the presence of cutouts 18 throughout the extent of heating element 16, a uniform adhesive bond between ply 20 and lamination 14 can be had. In one satisfactory technique for fabricating the device, ply 14 and lamination 20 are formed of commercially available material having three layers, namely: a layer of cured silicone rubber, a layer of glass cloth and a layer of uncured or partially cured silicone rubber. Heating element 16 is placed on the uncured layer of one of the elements (ply 14 or lamination 20) and the uncured layer of the other element is brought into contact with the former layer. Then, the device is placed in a heated press and subjected to heat and pressure until the uncured material cures. As the material cures it enters the cutouts 18 and forms a uniform adhesive bond. Because the layers of the elements substantially lose independent existence during fabrication, they are not shown as separate elements in FIG. 2.

Overlying the outer surface of ply 20 is an impervious conductive sheet 22. Preferably the sheet is formed of aluminum having a thickness sufficient to afford protection to the balance of the apparatus but thin enough to be conformable to curved surfaces such as the external surface of tank T. In one device designed in accordance with the invention, sheet 22 is formed of aluminum having a thickness of about 0.010 inches.

Figure 3:
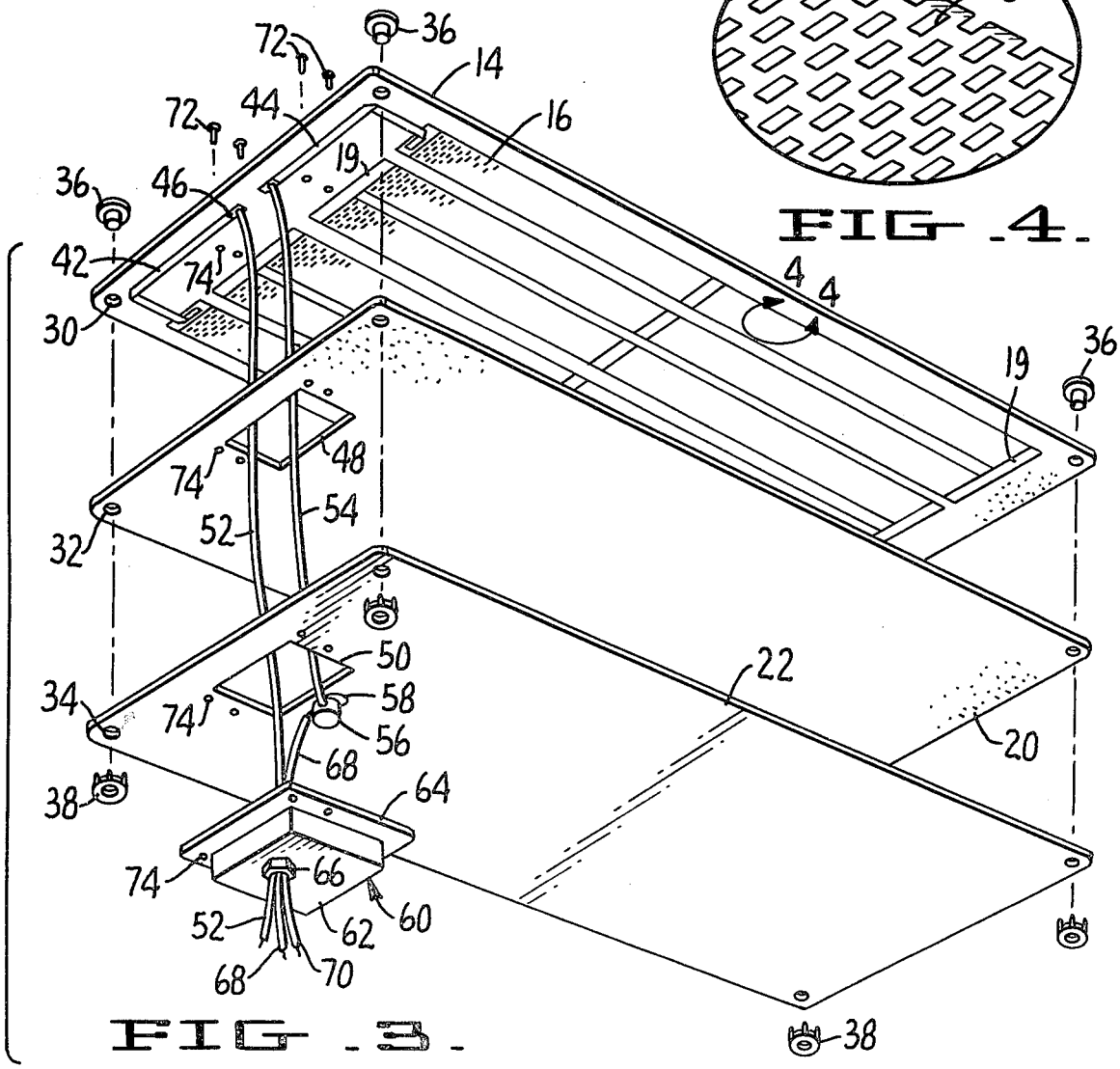
FIG. 3 is an exploded view of heating apparatus constructed in accordance with the invention.

As can be seen in FIG. 3, ply 16, lamination 20, and sheet 22 are congruent to one another. At two or more spaced apart locations in the apparatus, and preferably at all four corners when the apparatus is rectangular as shown in the drawings, there are sets of registered holes in the members that constitute the device. More specifically, insulative ply 14 defines a hole 30, insulative lamination 20 defines a hole 32 and conductive sheet 22 defines a hole 34. The holes are preferably formed in one operation after assembly of the device. A grommet composed of a body 36 and a keeper 38 is inserted into each set of holes. Alternatively, self punching grommets can be employed in which case the holes are punched and a grommet is inserted in one operation. The grommet assists in retaining the apparatus in a laminated condition, establishes a conductive path between the surface of tank T and conductive plate 22 and defines an opening 40 through which wire W can be looped to facilitate retention of the apparatus in position on a tank or pipe.

Adhered to ply 14 are electrical ribbon conductors 42 and 44 which are electrically connected to respective ends of resistive heating element 16. The ribbon conductors terminate in connector pads 46 which are spaced from but adjacent one another and are interior of the edge margin of the apparatus. Lamination 20 and conductive sheet 22 are formed with respective apertures 48 and 50 which are in registry with one another and with pads 46 on ribbon conductors 42 and 44. Extending through the registered apertures and bonded to the pads is a first power conductor 52 and a second power conductor 54. Power conductor 54 is connected to one terminal of a thermal cutout 56. Thermal cutout 56 is bonded by thermal cement 58 to the surface of conductive sheet 22 on the margin of aperture 50 so as to be in heat conducting relation to the conductive sheet. The thermal cutout functions to establish an electrical path between its two terminals below a prescribed temperature and to open the circuit at temperatures above the prescribed temperature.

A junction box 60 is provided and is preferably formed of conductive material such as aluminum. The junction box can be stamped to form a main chamber portion 62 of generally hollow parallelepiped shape surrounded by a continuous flange 64. Chamber portion 62 has an outer surface extending generally parallel to the flange. In the outer surface is formed a hole that receives an adapter 66 for guiding conductors therethrough. Power conductor 52 extends through the adapter and a conductor 68 extends from a terminal of thermal switch 56 through the adapter. Finally there is a ground conductor 70 which extends through the adapter and is electrically connected to a screw terminal (not shown) on the inner part of the adapter. In FIG. 3 power conductors 52 and 54 are shown of substantially greater length than is actually the case, this being a drafting convention in the interests of clarity. Junction box 60 is fixed to the apparatus by rivets 72 which extend through appropriately positioned holes 74 in all of the parts including flange 64. The rivets mechanically fix junction box to the apparatus and establish an electrical path between the junction box and conductive sheet 22. After assembly it is preferred to fill the interior of junction box 60 with potting compound, the potting compound being introduced through adapter 66.

Figure 1:
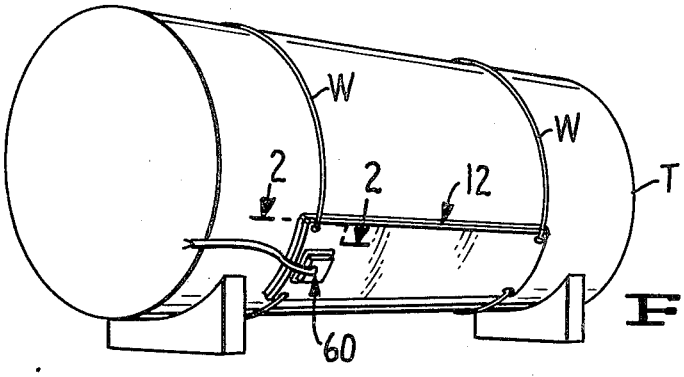
FIG. 1 is a perspective view of a tank on which heating apparatus of the invention is installed.

Because each of the planar members constituting the heating apparatus of the invention is flexible, the apparatus when assembled as described as above is similarly flexible or conformable. Thus the apparatus can be drawn into intimate heat conducting relation to a curved surface by suitable thermal adhesive applied to the inner surface of insulative ply 14 and by wires inserted through grommets 36 as seen in FIG. 1. An alternate technique of installation made possible by presence of the grommets is welding studs onto the exterior of tank T in a pattern corresponding to that of the grommets, installing the apparatus so that the studs protrude through the grommets, and engaging protruding ends of the grommets with spring steel stud clips. After the apparatus is installed, it can be covered with insulative material so as to prevent inadvertent contact with conductive sheet 22 and to reduce heat loss to the ambient atmosphere. The outer ends of the conductors are connected to a suitable power source and an area of substantially uniform heat energy, coextensive with the surface area of the apparatus, is created. Because of the presence of impervious conductive sheet 22 on the exterior of the apparatus, the likelihood of damage to the resistive heating element 16 is reduced or eliminated. Moreover, the presence of punchouts 18 within the conductor permits substantially uniform bonding throughout the area of the apparatus. The latter characteristic together with the presence of grommets 36 at the corners of the device provides a long-lasting extremely tough heating apparatus. Finally because conductive sheet 22 is grounded through ground conductor 70 and through grommets 36 in contact with the surface of tank T, electrical hazards are virtually nonexistent in apparatus constructed in accordance with the invention.

Although one embodiment has been shown and described, it will be obvious that other adaptations and modifications can be made without departing from the true spirit and scope of the invention.

What is claimed:

1. Heating apparatus conformable to a curved surface comprising a flexible insulative ply having an outer face adapted for contact with the curved surface, said insulative ply having an inner face opposite from said outer face, an elongate resistive heating element adhered to said inner surface, an insulative lamination substantially coestensive with said insulative ply and being adhered to said resistive heating element and to the inner surface of said insulative ply, a substantially impervious conductive sheet substantially coextensive with said insulative ply adhered to said insulative lamination, said heating element being spaced inward of the edge margin of said apparatus to form four corner margin areas constituted by said ply, lamination and sheet, a set of registered holes formed in each said marginal corner area for facilitating installation of said apparatus and a conductive grommet disposed in each said hole set in physical and electric contact with said conductive sheet, and connecting means for applying power to said resistive heating element and for grounding said conductive sheet.

2. The heating apparatus of claim 1 wherein said connecting means includes a conductive junction box, means for securing said junction box to said conductive sheet in electrically conductive relation thereto, a first power conductor having a proximal end connected to one end of said elongate resistive heating element and a distal end extending exterior of said junction box, a second power conductor having a proximal end connected to the opposite end of said resistive heating element and a distal end extending exterior of said junction box and a ground conductor having a proximal end connected to said conductive sheet and a distal end extending exterior of said junction box.

3. The heating apparatus of claim 2 including a thermal cutout switch connected in series with said first power conductor, said thermal cutout being disposed within said junction box and being secured to said conductive sheet in heat conductive relation thereto, said thermal cutout opening the circuit constituted by said first power conductor in response to attainment of a preselected temperature by said conductive sheet.

4. The heating apparatus of claim 3 wherein said conductive sheet and said junction box are formed of aluminum.

* * * * *